US005699918A

United States Patent [19]

Dunn

[11] Patent Number: 5,699,918

[45] Date of Patent: Dec. 23, 1997

[54] SCREEN FOR VIBRATING MATERIAL SORTING APPARATUS

[75] Inventor: Donald C. Dunn, Mesa, Ariz.

[73] Assignee: Corrosion Engineering, Inc., Mesa, Ariz.

[21] Appl. No.: 687,719

[22] Filed: Jul. 26, 1996

[51] Int. Cl.[6] ..... B07B 1/49

[52] U.S. Cl. ..... 209/397; 209/399

[58] Field of Search ..... 209/397, 399, 209/405, 407, 408, 412

[56] References Cited

U.S. PATENT DOCUMENTS

| | | | |
|---|---|---|---|
| 3,365,059 | 1/1968 | Hobbs | 209/397 X |
| 4,840,728 | 6/1989 | Connolly et al. | 209/397 X |
| 4,882,044 | 11/1989 | Freissle | 209/397 X |
| 5,341,939 | 8/1994 | Aitchison . | |
| 5,372,261 | 12/1994 | Galton et al. | 209/399 |
| 5,385,241 | 1/1995 | Bokor | 209/399 |

*Primary Examiner*—David H. Bollinger
*Attorney, Agent, or Firm*—LaValle D. Ptak

[57] ABSTRACT

A screen for a vibrating material sorting apparatus of the type used to sort material in mining operations and the like has a plurality of rows and columns of trapezoidal apertures formed through it. The apertures are oriented so that the narrowest end first encounters material moving down the screen. The apertures are further tapered in cross section, and flare outwardly from the top surface of the screen to the bottom surface. In addition, each of the apertures slopes at an angle which is selected to be the same as the degree of incline of the screen when it is mounted in a vibrating material sorting apparatus.

20 Claims, 2 Drawing Sheets

SCREEN FOR VIBRATING MATERIAL SORTING APPARATUS

BACKGROUND

Vibrating material sorting screens are used in a variety of applications, including sand and gravel businesses and in mining operations. Such vibrating screens are used to sort material size and typically comprise an elongated screening deck, which slopes downwardly from the feed end to the material delivery end. The deck is mounted in a deck-holding frame, which in turn is supported on springs extending to a platform on a support surface. An eccentric vibrator is employed to vibrate the frame on the springs. This causes a shaking of the material poured onto the screen deck to facilitate the movement of the material down the deck, and to expedite the material separation. Both the apertures of the screen and the size of the deck determine the separation size of the materials. Any material which is larger than the screen aperture finally is supplied from the end of the deck to a suitable receptacle, or for screening by a subsequent screen with larger apertures in it. All material which is smaller than the screen aperture size falls through the deck for further separation or processing.

For mining operations, the screen may be in the form of thick reinforced rubber-like material. A typical thickness is approximately two inches; and the apertures generally have been in the form of square cross sections in the planes parallel to the surfaces of the screen. These apertures extend perpendicularly through the screen between the upper and lower surfaces. Sometimes the screens are made in the form of replaceable modules, since different sections of the screen wear at different rates. By employing replaceable modules, only the worn sections of a large screen need to be replaced when these sections become worn out.

In conventional vibrating screens, when the screen is raised at one end to produce the downward slope from the feed end to the delivery end, the result of apertures which are perpendicular to the screen surfaces is such that material does not drop straight through the screen in a vertical direction. Instead, once the material enters the aperture it must move slightly backward toward the feed end of the screen before it passes through the screen. This is standard construction used with screens designed for mining operations; but such an orientation tends to impede the efficient operation of the screen and, in some cases, may result in "pegging" or clogging of the aperture by near-sized material.

In the past, efforts have been made to reduce "pegging" of the apertures by flaring outwardly the sides of the apertures from the top surface to the bottom surface of the screen; so that if material passes through the aperture at the top surface, it has a better chance of passing completely through the screen. Pegging or plugging of apertures is a serious problem, particularly in mining operations where if enough of the apertures are "pegged" or plugged, the screen ceases to function well as a separating device and simply operates as a chute, with the material being fed onto it passing over the screen from its feed end to its discharge end.

It is desirable to provide a vibrating screen particularly suited for use with mining operations, which overcomes the disadvantages of the prior art screens noted above and which facilitates the flow of separated material through the screen with a reduction in pegging.

SUMMARY OF THE INVENTION

It is an object of this invention to provide an improved screen for a vibrating material sorting apparatus.

It is another object of this invention to provide an improved screen for a vibrating material sorting apparatus which reduces the chances of material "pegging" the screen apertures.

It is another object of this invention to provide a screen for a vibrating material sorting apparatus which has sloped apertures corresponding to the degree of incline of the screen when it is mounted in the material sorting apparatus.

It is a further object of this invention to provide a screen for a vibrating material sorting apparatus which has a plurality of trapezoidal shaped apertures in it, with the apertures further being tapered in width and length through the screen.

In a preferred embodiment of the invention, a screen for a vibrating material sorting apparatus comprises a main body member. The body member has an upper planar surface and a lower surface, and is designed to be mounted in a material sorting apparatus. A plurality of elongated trapezoidal-shaped apertures are formed through the main body member, between the upper and lower surfaces, at an angle which is selected to be substantially the same as the degree of incline of the screen when it is mounted in a material sorting apparatus.

DETAILED DESCRIPTION

Figure 1:
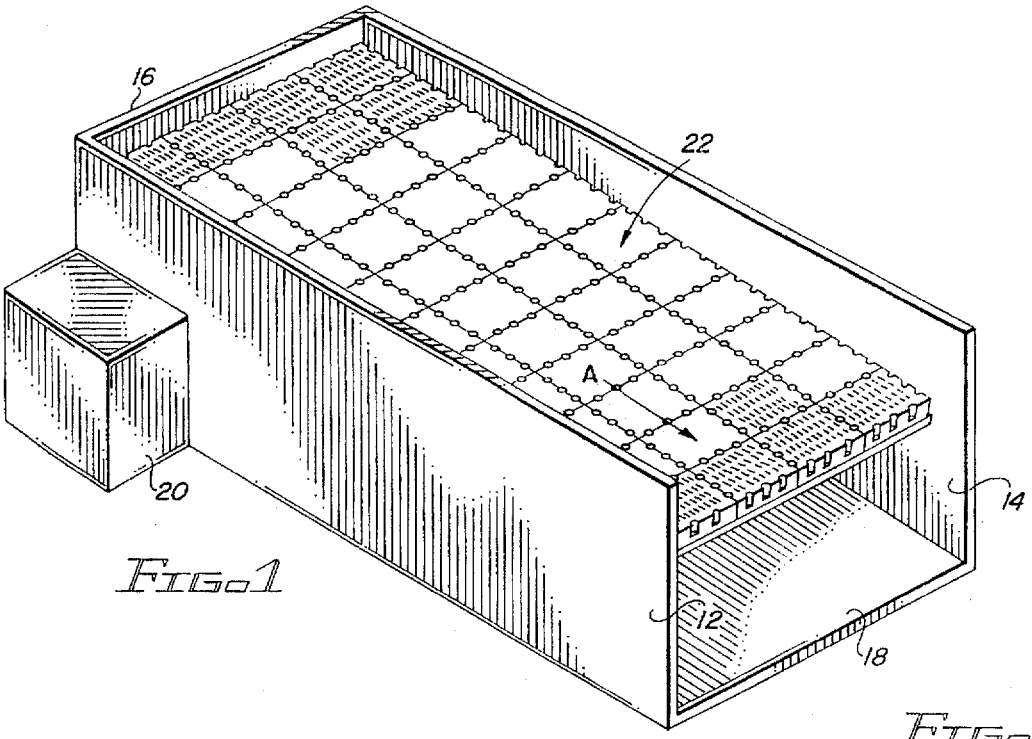
FIG. 1 is a perspective view of a material sorting apparatus including a preferred embodiment of the invention.

Reference now should be made to the drawing, in which the same reference numbers are used throughout the different figures to designate the same components. FIG. 1 is an overall perspective view of the general configuration of a vibrating screen apparatus of the type used to screen or sort material sizes. Smaller material passes through the vibrating screen and larger material is delivered from the screen at the end. Such a vibrator may be of a multiple deck type disclosed in the Aitchison et al. U.S. Pat. No. 5,341,939, or standard types of single deck vibrators.

The vibrator apparatus includes a box-like structure or frame, shown in FIG. 1 as having a pair of elongated upright sides 12 and 14, a base 18, and a front wall 16. The rear or product delivery end of the device shown in FIG. 1 is open. A screen 22 having apertures in it for effecting the material sorting operation is mounted at an incline which is higher at the product feed end (the left-hand end in FIG. 1) and lower at the product delivery end (the right-hand end in FIG. 1). A typical incline for screens used in sorting material in mining operations is between 20° and 30°, with a 25°.

A vibrator apparatus in the form of a drive motor and eccentric vibrator is mounted in a housing 20. This motor and the eccentric weight for vibrating the frame on which the screen 22 is mounted may be of conventional construction; and for that reason, details of this structure are not shown in FIG. 1.

Figure 2:
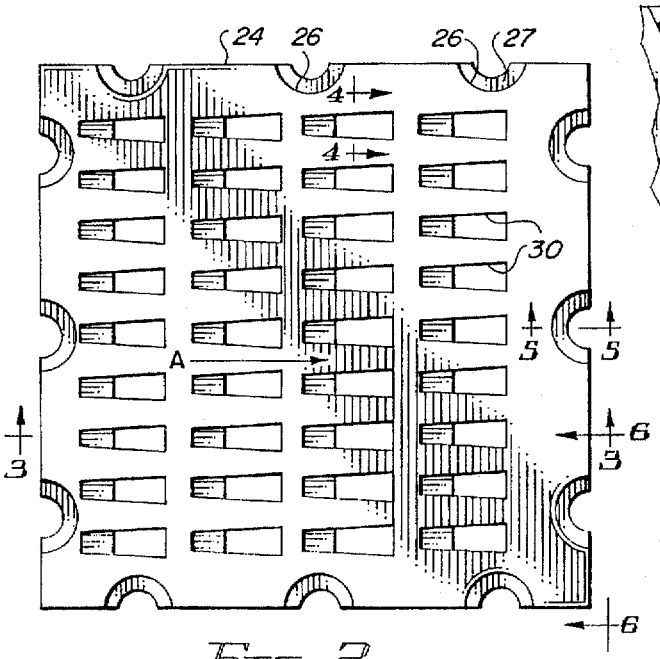
FIG. 2 is a top view of a preferred embodiment of the invention.
Figure 6:
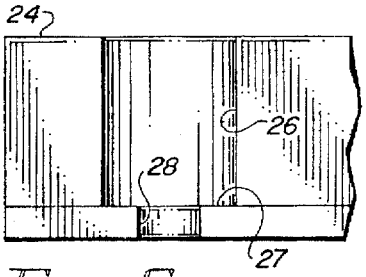
FIG. 6 is a view taken along the line 6—6 of FIG. 2.

Reference now should be made to FIGS. 2 through 6, which illustrate details of the vibrator screen 22 shown in FIG. 1. FIG. 2 is a top view of a vibrator screen module 24 constructed in accordance with a preferred embodiment of the this invention. The module 24 is of the same general configuration as screen modules currently employed in the mining art, and typically is a square of approximately 12 inches with a thickness of approximately 2 inches. The material out of which the module 24 is manufactured is reinforced rubber or reinforced rubber-like material with a high resistance to abrasion.

As illustrated in FIG. 2, apertures 30 selected to pass or screen smaller particles from larger particles are arranged in rows and columns on the module 24. The arrow "A" shown in FIGS. 1 and 2 represents the direction of flow of the material to be sorted as it passes from the higher end of the screen 22 or module 24 to the lower end of the screen or module. In FIG. 2, it may be seen that the apertures for effecting sorting are in the form of trapezoidal openings, the narrow ends of which are shown in FIG. 2 on the left-hand side. This is the "up-stream" side for the material flow, that is, material passing over the screen moves from left to right in the representation shown in FIG. 2. The wider ends of the trapezoidal slots 30 are located at the right-hand end or "downstream" in the flow of material across the screen module 24. It is readily apparent that the apertures 30 are not uniform, but rather are tapered along their length to form the trapezoidal opening. For example, a typical aperture size (clearly not intended to be restrictive of aperture size in any way) may be with an aperture 30, which is two inches long, having the narrow end of the trapezoid ⅜ inches wide and the wide end being ⅝ inches wide on the top surface of the module 24. This aperture is substituted for a standard square aperture having ½ inch dimensions on both sides. By using the trapezoidal shape, "near-sized" material which could get caught in a standard ½ inch aperture and cause "pegging" or plugging of the aperture hole is jostled and moved through the trapezoidal aperture 30.

Figure 5:
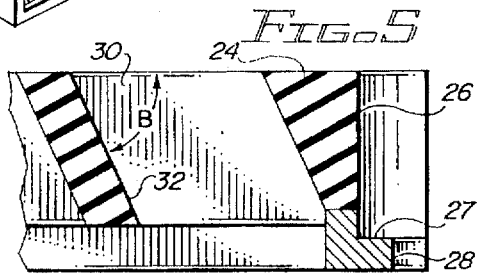
FIG. 5 is a cross-sectional view taken along the line 5—5 of FIG. 2.
Figure 3:
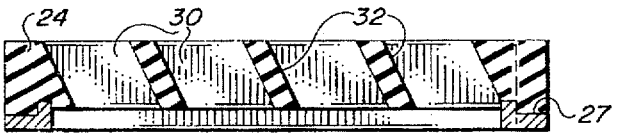
FIG. 3 is a cross-sectional view taken along the line 3—3 of FIG. 2.

As is most readily apparent from an examination of FIGS. 3 and 5, the apertures 30 also are sloped forward from the top surface to the lower surface of the screen module 24 at an angle "B" which is in the 20° range to the 30° range. This angle "B" is selected to be the same degree of incline as the incline of the vibrating screen shown in FIG. 1. The result is that material which passes through the upper surface of the aperture 30 drops straight down or vertically through the screen 24 to the region beneath the screen. This is contrasted with standard screens, where the incline of the screen in the vibrator causes material which passes through an aperture perpendicular to the screen surface to make a slight rearward movement from the product flow over the top of the screen as it passes through the screen. This "rearward" movement in standard screens also causes some "near-sized" material to peg or plug the holes. The vertical orientation of the apertures 30 by means of the sloped surfaces 32 assists in reducing the possibility of pegging of near-sized material.

Figure 4:
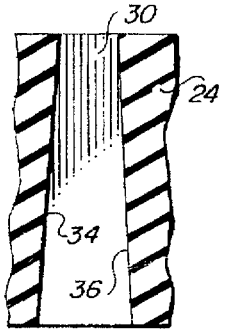
FIG. 4 is a cross-sectional view taken along the line 4—4 of FIG. 2.

FIG. 4 is a transverse cross-sectional view of the slot 30, which illustrates the manner in which the two sides 34 and 36 of the slot 30 flare outwardly or diverge away from one another as the slot extends from the upper surface of the screen module 24 to the lower surface. This also results in a trapezoidal cross section with the narrow dimension of the trapezoid located at the top surface of the module 24 and the widest or base end of the trapezoid located at the lower surface of the module 24. For the specific example of the present illustration, the bottom surface within the top and base of the trapezoid are ½ inches and ¾ inches, respectively.

The screen shown in modular form in FIGS. 2 through 6 also may be made in a single or unitary structure for some applications, if desired. The modular structure which is shown in the various figures of this application, however, is a preferred form of screen configuration to permit replacement of only those modules 24 of the screen which become worn; so that replacement of the entire screen 22 is not necessary at any given time. Since the apertures 30 are tapered in all dimensions: length, width, and thickness, the pegging of the apertures by "near-sized" material is considerably reduced over standard vibrating screens using square or rectangular apertures.

The manner in which the modules are constructed for attachment to an underlying vibrating frame in the vibrator apparatus is shown in greater detail in FIGS. 2, 3 and 5 through 9. As is readily apparent from an examination of FIG. 2, semi-circular cut outs are formed on all four sides of the screen module 24. These cut outs 26 are sized to accommodate a bolt 50 (FIGS. 8 and 9) and a washer 52. Each of the modules 24 is constructed with an L-shaped metal flange 27 along all four edges of the module. The rubber-like material of the module 24 is bonded to the flanges 27 in any suitable manner. As is illustrated most clearly in FIGS. 5 and 6, the opening 26 through the rubber-like material is larger than the opening 28 through the flange 27 in each of the semi-circular cut outs along the edges of the modules 24.

Figure 7:
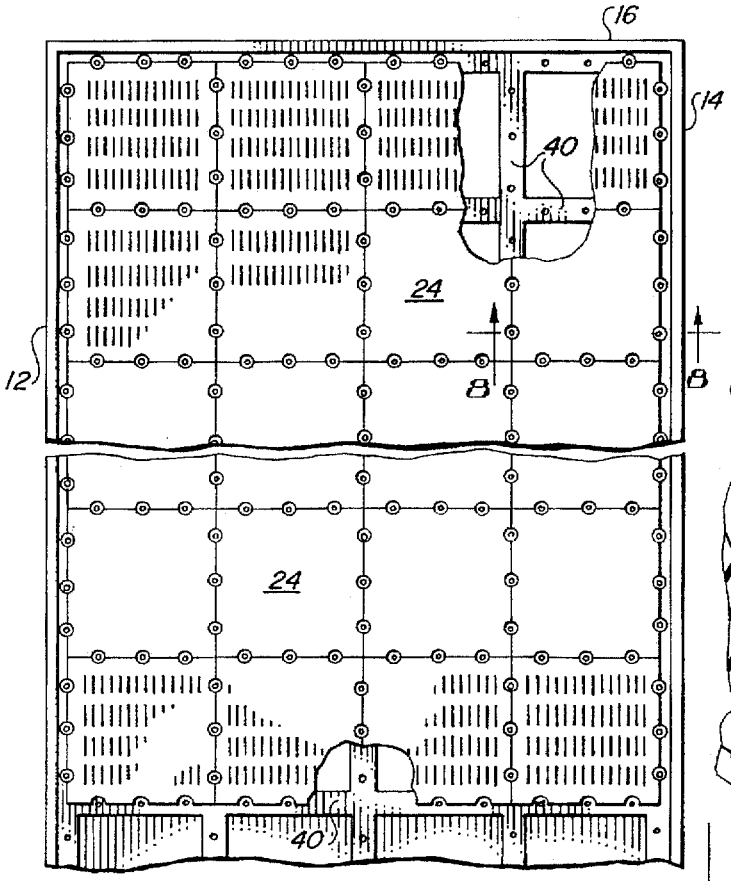
FIG. 7 is a top view of a portion of the apparatus shown in FIG. 1 illustrating the manner of mounting the embodiment shown in FIG. 2.
Figure 9:
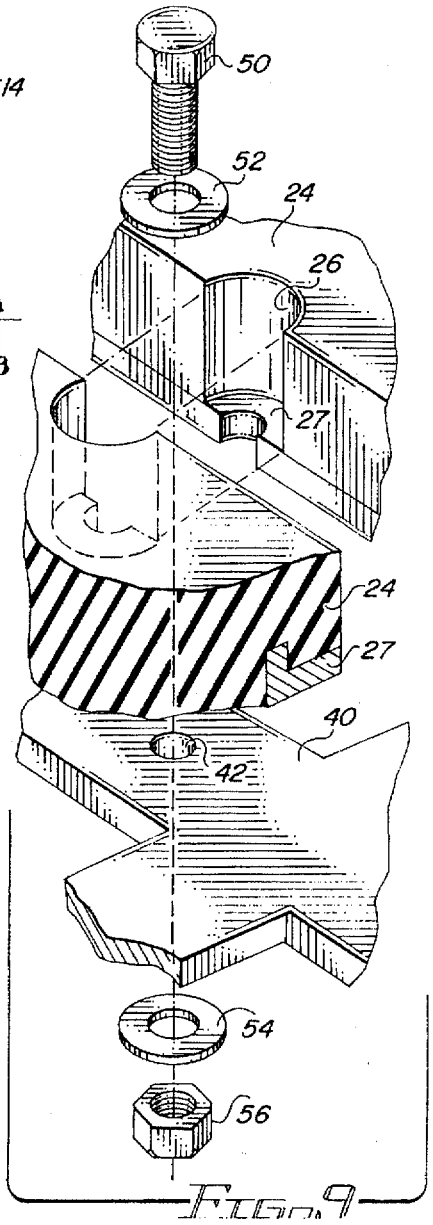
FIG. 9 is an exploded detail showing the manner of assembling the embodiment of the invention to the frame shown in FIGS. 7 and 8.
Figure 8:
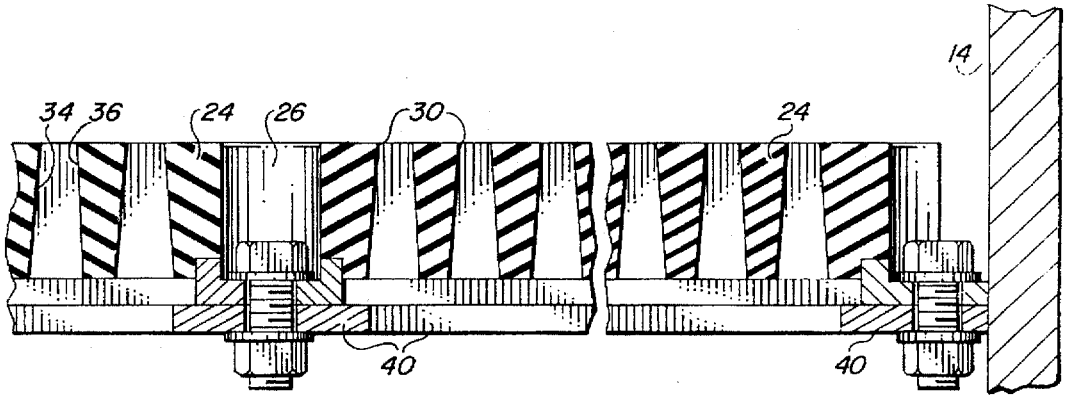
FIG. 8 is a cross-sectional view taken along the line 8—8 of FIG. 7.

As shown in FIG. 7, the modules 24 overlie a frame 40 comprised of square grids. This frame is spring mounted in the vibrator apparatus shown in FIG. 1 in any suitable manner, including the mounting which is disclosed in the aforementioned U.S. Pat. No. 5,341,939. As shown in detail in FIGS. 8 and 9, the frame 40 has holes 42 formed through it for accommodating the bolts 50. A washer 54 and a nut 56 then is placed on the underside of the frame 40; and the adjacent screen modules 24 are clamped in place as illustrated in FIGS. 8 and 9. This type of mounting of screen modules is conventional.

The foregoing description of the preferred embodiment of the invention is to be considered as illustrative and not as limiting. For example, the dimensions and materials may be changed to meet particular operating requirements. Although the invention is particularly suited for separating mining materials, it could also be used in standard gravel operations. Various changes will occur to those skilled in the art for performing substantially the same function, in substantially the same way, to achieve substantially the same result without departing from the true scope of the invention as defined in the appended claims.

What is claimed is:

1. A screen for a vibrating material sorting apparatus including in combination:

a main body member having an upper planar surface and a lower surface for mounting in a material sorting apparatus, said main body member having a plurality of elongated trapezoidal apertures formed therethrough between said upper and lower surfaces for permitting material of a predetermined size determined by the dimensions of said apertures to pass therethrough from said upper surface of said main body member.

2. The combination according to claim 1 wherein said plurality of elongated trapezoidal apertures comprise apertures of equal size.

3. The combination according to claim 2 wherein said trapezoidal apertures are aligned in a direction to first contact material moving across said screen from the narrowest end of said apertures to the widest end thereof.

4. The combination according to claim 3 wherein said plurality of elongated trapezoidal apertures are arranged in rows and columns.

5. The combination according to claim 4 wherein said trapezoidal apertures are formed through said main body member at a predetermined angle to the plane of said upper surface.

6. The combination according to claim 5 wherein said predetermined angle of said elongated trapezoidal apertures is selected to be substantially the same as the angle at which said screen is designed for mounting in a vibrating material sorting apparatus.

7. The combination according to claim 6 wherein the sides of said trapezoidal apertures formed through said main body member are divergent so that the trapezoidal apertures in said upper surface are smaller than the corresponding trapezoidal apertures in said lower surface of said main body member.

8. The combination according to claim 7 wherein said lower surface of said main body member is a planar surface parallel to the planar surface of said upper body member.

9. The combination according to claim 8 wherein said main body member is made of reinforced rubber-like material.

10. The combination according to claim 9 wherein said main body member comprises a modular component of a screen consisting of a plurality of said main body members mounted on a frame.

11. The combination according to claim 1 wherein all of said trapezoidal apertures are oriented in the same direction.

12. The combination according to claim 11 wherein said apertures formed through said main body member have outwardly flaring side walls extending from said upper surface of said main body member to said lower surface of said main body member.

13. The combination according to claim 1 wherein said trapezoidal apertures are formed through said main body member at a predetermined angle to the plane of said upper surface.

14. The combination according to claim 13 wherein said predetermined angle of said elongated trapezoidal apertures is selected to be substantially the same as the angle at which said screen is designed for mounting in a vibrating material sorting apparatus.

15. The combination according to claim 1 wherein the sides of said trapezoidal apertures formed through said main body member are divergent so that the trapezoidal apertures in said upper surface are smaller than the corresponding trapezoidal apertures in said lower surface of said main body member.

16. The combination according to claim 15 wherein said trapezoidal apertures are aligned in a direction to first contact material moving across said screen from the narrowest end of said apertures to the widest end thereof.

17. The combination according to claim 16 wherein said trapezoidal apertures are formed through said main body member at a predetermined angle to the plane of said upper surface.

18. The combination according to claim 3 wherein said plurality of elongated trapezoidal apertures are arranged in rows and columns.

19. The combination according to claim 18 wherein said trapezoidal apertures are aligned in a direction to first contact material moving across said screen from the narrowest end of said apertures to the widest end thereof.

20. The combination according to claim 1 wherein said trapezoidal apertures are aligned in a direction to first contact material moving across said screen from the narrowest end of said apertures to the widest end thereof.

* * * * *